US005987773A

United States Patent [19]

Lipscy

[11] Patent Number: 5,987,773

[45] Date of Patent: Nov. 23, 1999

[54] FOOT AND HAND APPAREL DRYER CABINET ASSEMBLY

[76] Inventor: Gordon E. Lipscy, 851 Auburn Mill Rd., Hockessin, Del. 19707

[21] Appl. No.: 09/123,195

[22] Filed: Jul. 27, 1998

[51] Int. Cl.[6] ..... F26B 25/00

[52] U.S. Cl. ..... 34/106; 34/202

[58] Field of Search ..... 34/103, 104, 106, 34/202, 210, 211, 218; 211/88, 181, 204; 312/213, 229, 249.3

[56] References Cited

U.S. PATENT DOCUMENTS

| | | |
|---|---|---|
| 1,688,793 | 10/1928 | Schrenkeisen . |
| 1,731,272 | 10/1929 | Schrenkeisen . |
| 2,465,362 | 3/1949 | Elliott . |
| 3,154,392 | 10/1964 | Littman . |
| 3,299,529 | 1/1967 | Roberts et al. . |
| 3,513,564 | 5/1970 | Gramprie . |
| 3,645,009 | 2/1972 | Ketchum . |
| 3,793,744 | 2/1974 | Saita . |
| 3,798,788 | 3/1974 | Kuntz . |
| 4,085,519 | 4/1978 | Masika . |
| 4,136,464 | 1/1979 | Hay . |
| 4,145,602 | 3/1979 | Lee . |
| 4,171,580 | 10/1979 | Vabrinskas . |
| 4,200,993 | 5/1980 | Blanc et al. . |
| 4,596,078 | 6/1986 | McCartney . |
| 4,682,424 | 7/1987 | Irving . |
| 4,727,656 | 3/1988 | Jannach et al. . |
| 4,768,293 | 9/1988 | Kaffka . |
| 4,967,060 | 10/1990 | Lomeli . |
| 5,003,707 | 4/1991 | Chu . |

(List continued on next page.)

FOREIGN PATENT DOCUMENTS 406038918 2/1994 Japan .

OTHER PUBLICATIONS

Internet—INFO atOSMA.de—Boot Dryer Advertisement Jul. 22, 1998—Germany.
Internet—http://www.jili.com/—Boot Dryer Advertisement Jul. 22, 1998—USA.
Internet—http://members.aol.com./mainewd/wwdboot.html Boot Dryer Advertisement Jul. 22, 1998—USA.
Internet—http:/www.rei.com/shopping/store3/skiing/Alpine—Boot Dryer Advertisements Jul. 22, 1998—USA.
Internet—http:/beachcomber.com/gadget—Boot Dryer Advertisement Jul. 22, 1998—USA.
Internet—http:/www/bootdryer.com/com.htm—Boot Dryer Advertisement Jul. 22, 1998—Canada.
Internet—http:/www.skinet/com/gear/97—Boot Dryer Advertisement Jul. 22, 1998—USA.
Internet—http:/www.electric–outlet.com.www.eo/lg3d.htm Boot Dryer Advertisement Jul. 22, 1998—USA.

*Primary Examiner*—Henry Bennett
*Assistant Examiner*—Steve Gravini

[57] ABSTRACT

An apparatus for overnight drying and storage of wet boots, shoes, gloves, mittens and the like, which consists of a furniture-style cabinet with capacity to hold and dry all of the foot and hand apparel of a family or other group in a typical vacation lodging environment. The cabinet contains means to support apparel for drying and a drying air distribution device wherein ambient drying air is drawn-in from the surrounding room and is fan driven from a plenum into a plurality of individual conduits through conduit flow restrictors. By resisting the free flow of air, conduit flow restrictors act to substantially equalize the air flow through all conduits, regardless of length. The individual conduits convey the ambient drying air to the interior chambers of the apparel items and cause overnight drying. Air mixing within the cabinet assures overnight drying of the exterior surfaces of apparel. The drying operation is performed quietly and conveniently behind closed doors with damp air being exhausted out holes in the cabinet back. Since drying is completed without electrical heaters or hot surfaces, there are no associated risks of fire, injury or apparel damage. This is an energy conservation device.

9 Claims, 2 Drawing Sheets

U.S. PATENT DOCUMENTS 5,016,364 5/1991 Cochrane .
5,179,790 1/1993 Poulos .
5,199,188 4/1993 Franz .
5,222,308 6/1993 Barker et al. .
5,287,636 2/1994 La Fleur et al. .
5,379,525 1/1995 Raynor .
5,412,928 5/1995 Reithel .
5,528,840 6/1996 Pajak et al. .
5,546,678 8/1996 Dhaemers ..... 34/224 X
5,570,515 11/1996 Schulte .
5,592,750 1/1997 Eichten .
5,666,743 9/1997 Dawson .
5,720,108 2/1998 Rice .
5,729,908 3/1998 Braden .
5,755,040 5/1998 Ou .

FOOT AND HAND APPAREL DRYER CABINET ASSEMBLY

BACKGROUND-FIELD OF INVENTION

This invention relates to the drying of foot and hand apparel such as boots, shoes, gloves, mittens and the like following use in winter sports or other activities that impart external or perspiration moisture to such apparel.

BACKGROUND-DESCRIPTION OF PRIOR ART

In a typical ski lodging environment, from 4 to 8 skiers have a need to dry from 16 to 32 separate pieces of hand and foot apparel overnight. A drying apparatus for such an environment should be safe and convenient, effective and economical, and contribute to the aesthetics of the ski lodging atmosphere. A plethora of methods and apparatus have been disclosed over the years for expediting the evaporation of moisture from boots, shoes, mittens, gloves and other items of apparel that have been wetted by external moisture or perspiration. Generally, the prior art involves circulation of dry air around or within the item of apparel. Disclosures of the prior art can be categorized as follows:

A. Devices that sit over forced air furnace floor registers and direct air flow into the interior chambers of the apparel, such as U.S. Pat. No. 4,085,519 (Masika April 1978); No. 4,136,464 (Hay January 1979) and No. 4,596,078 (McCartney June 1986).

Among other operational limitations, these devices are severely limited in their general application due to the need for an available furnace register to supply the circulation of dry air and continuous operation of the furnace.

B. Drying stands and drying trees where boots (typically) are inverted over conduits flowing heated air into the interior chambers, such as U.S. Pat. No. 1,731,272 (Schrenkeisen October 1929); No. 2,465,362 (Elliot March 1949); No. 3,798,788 (Kuntz March 1974); No. 4,200,993 (Blanc et al. May 1980); No. 4,727,656 (Jannach et al. March 1988); No. 5,199,188 (Franz April 1993) and No. 5,412,928 (Reithel May 1995), and Japanese patent 406038918 (February 1994)

The devices represented by these disclosures all contain electrical heaters which present a fire safety hazard as well as a potential for apparel damage from overheating. While these devices can typically accommodate a good number of apparel items, their raw features would seriously detract from the aesthetics of a ski lodging environment These devices are mainly found in commercial drying applications.

C. Portable devices, which provide heated air from fans and electrical heaters (or hair dryers) via conduits to the interior chambers of apparel items, such as U.S. Pat. No. 3,154,392 (Littman October 1964); No. 3,299,529 (Roberts et al January 1967); No. 3,513,564 (Gramprie May 1970); No. 3,645,009 (Ketchum February 1972); No. 4,768,293 (Kaffka September 1988); No. 4,967,060 (Lomeli October 1990); No. 5,003,707 (Chu April 1991); No. 5,179,790 (Poulos January 1993); No. 5,222,308 (Barker et al June 1993); No. 5,287,636 (Lafleur et al. February 1994); No. 5,379,525 (Raynor January 1995); No. 5,592,750 (Eichten January 1997); No. 5,720,108 (Rice February 1998) and No. 5,729,908 (Braden March 1998).

The devices represented by these disclosures are all designed to be transported by the user to the location in which drying is desired. They all include electrical heaters, which present a fire safety hazard as well as a potential for apparel damage from over heating. Approximately one half of these devices require the use of a portable hair dryer, which further adds to the safety risk and causes a high noise level during the drying process. Most of these portable devices are compact in nature and only accommodate one pair of boots or gloves at a time. Use of these devices to dry from 16 to 32 pieces of apparel each day would be very labor intensive and aesthetically unpleasant.

D. Portable devices, which provide ambient air from a fan via conduits to the interior chambers of apparel items, such as U.S. Pat. No. 4,171,580 (Vabrinskas October 1979) and No. 5,570,515 (Schulte November 1996)

These devices eliminate the hazards associated with electrical heaters in return for longer drying time. The disadvantages of these devices are in the fact that, being compact and portable, they can only dry one pair of boots (no gloves) at a time. Thus, a group would have to travel with several of these devices or interrupt their sleep to dry all boots overnight The size of the conduits disclosed by these patents is too large to fit into most gloves or mittens.

E. Coin operated boot and glove warmer with electric heater, fan and conduits to the interior chambers of apparel, such as U.S. Pat. No. 4,145,602 (Lee March 1979)

This device has high noise levels, the safety hazards of electrical heaters and requires constant monitoring during the drying process to prevent overheating.

F. Portable devices with fans, which provide ambient air flow through an enclosure in which apparel is placed for drying, such as U.S. Pat. No. 5,528,840 (Pajak et al. June 1996) and No. 5,666,743 (Dawson September 1997).

These devices, although absent the hazards associated with electrical heaters, do not provide forced circulation of the air into the interior chambers of the apparel. This would prevent thorough overnight drying of tall boots or long gloves. Also, these portable devices are sized to accommodate only a single pair of boots or gloves at a time and suffer the disadvantages discussed in C and D above.

G. Drying cabinets with electrical heaters and fans, which provide heated air flow around apparel items placed within the cabinet, such as U.S. Pat. No. 4,682,424 (Irving July 1987): No. 5,016,364 (Cochrane May 1991) and No. 5,755,040 (Ou May 1998).

The devices represented by these disclosures provide the convenience for drying a large number of apparel items in a single closed cabinet. The drawbacks of these devices are the hazards of electrical heaters and the absence of capability to force a circulation of air into the interior chambers of apparel items. The stagnation of the air inside tall boots and gloves would result in much longer drying times and wasted electrical energy.

H. Drying cabinets with electrical heaters, fans and conduits to direct air flow to individual apparel items, such as U.S. Pat. No. 1,688,793 (Schrenkeisen October 1927) and No. 3,793,744 (Saita February 1974)

The devices represented by these disclosures provide the convenience and tidiness of cabinet storage of shoes during the drying process. However, both disclosures lack accommodation of large boots or hand apparel by virtue of the mechanical designs claimed. Both disclosures included electrical heaters, which represent a safety hazard. Neither disclosure addresses the necessity to exhaust damp air from the cabinets; thus, one must presume that they operate with the doors open, which would diminish the aesthetics.

OBJECTS AND ADVANTAGES

Many families or groups of individuals enjoy outdoor activities such as skiing and hiking which can result in wet or damp foot and hand apparel. Modern composite fabrics and materials provide comfort, insulation, lightweight and effective barriers to external moisture in boots, gloves and mittens. However, these same properties restrict the removal of perspiration or other moisture from within such apparel. The prior art has clearly demonstrated the benefits of circulating drying air to the interior chambers of such apparel to achieve dryness for next day use. The prior art, however, has not disclosed a foot and hand apparel dryer cabinet assembly, which provides safe, convenient, effective, economical, and aesthetic overnight drying and storage of the damp apparel for an entire group. The present invention meets these objectives as follows:

Safe—The present invention circulates the ambient air from the room in which the cabinet is located. No electrical heating is required. No potential for overheating exists. No hot components are present. There are none of the electrical shock hazards associated with portable appliances. Apparel may be left in the cabinet with the fan running for days or weeks without fear of damage. The cabinet is safe for small children to operate.

Convenient—The present invention is an item of furniture to be provided at overnight lodging facilities. It requires no assembly. Extra baggage space for portable dryers is eliminated. Skiers and hikers of all ages can insert their own apparel into the cabinet and initiate the drying process. There is no need to monitor the drying process or sequence apparel into and out of the cabinet during the night. The cabinet also provides closed door storage for all hand and foot apparel during and after drying.

Effective—The present invention works on the principle of replacing the damp air inside apparel items with the lower relative humidity air of the room. This circulation forces high humidity air out of the apparel and results in the drying action. The present invention has been proven in tests to dry ski boots and gloves overnight using only the installed fan to circulate ambient air. There is no risk of deterioration of apparel items from excessive heat.

Economical—The fan operates on 120 volt house power for only pennies per day of continuous operation. The present invention results in significant energy conservation when compared to the majority of the prior art devices, which utilize electrical heaters. The present invention utilizes readily available construction materials and can be constructed using economical prefabricated cabinets. Cabinet assemblies can be custom sized, both in width and by vertical stacking of assemblies, to accommodate the drying needs of any sized group or lodging unit.

Aesthetic—The present invention provides a major advantage over the prior art for apparel drying applications in a typical ski condominium or house as follows:

1) In the often cozy quarters of vacation lodging, boots and gloves can clutter the floor space and diminish the enjoyment of the setting. The present invention allows this apparel to be stored and dried behind closed doors in a furniture cabinet
2) Most prior art devices, particularly devices utilizing portable hair dryers, generate a high level of noise, which can be annoying in a confined area. The fan incorporated into the present invention was selected and mounted so as to provide less noise than a typical furnace fan. This design feature permits the present invention to be located in a sleeping area if desired. Operation of the present device does not detract from TV viewing, conversation, or a crackling fire.
3) The common location for all hand and foot apparel items afforded by the present invention provides visual assurance that all group members have addressed their personal apparel drying needs and eliminates next day anguish from finding misplaced or wet apparel items.

Still further objects and advantages will become apparent from consideration of the ensuing description and drawings.

DRAWING FIGURES

REFERENCE NUMERALS IN DRAWINGS

Figure 1:
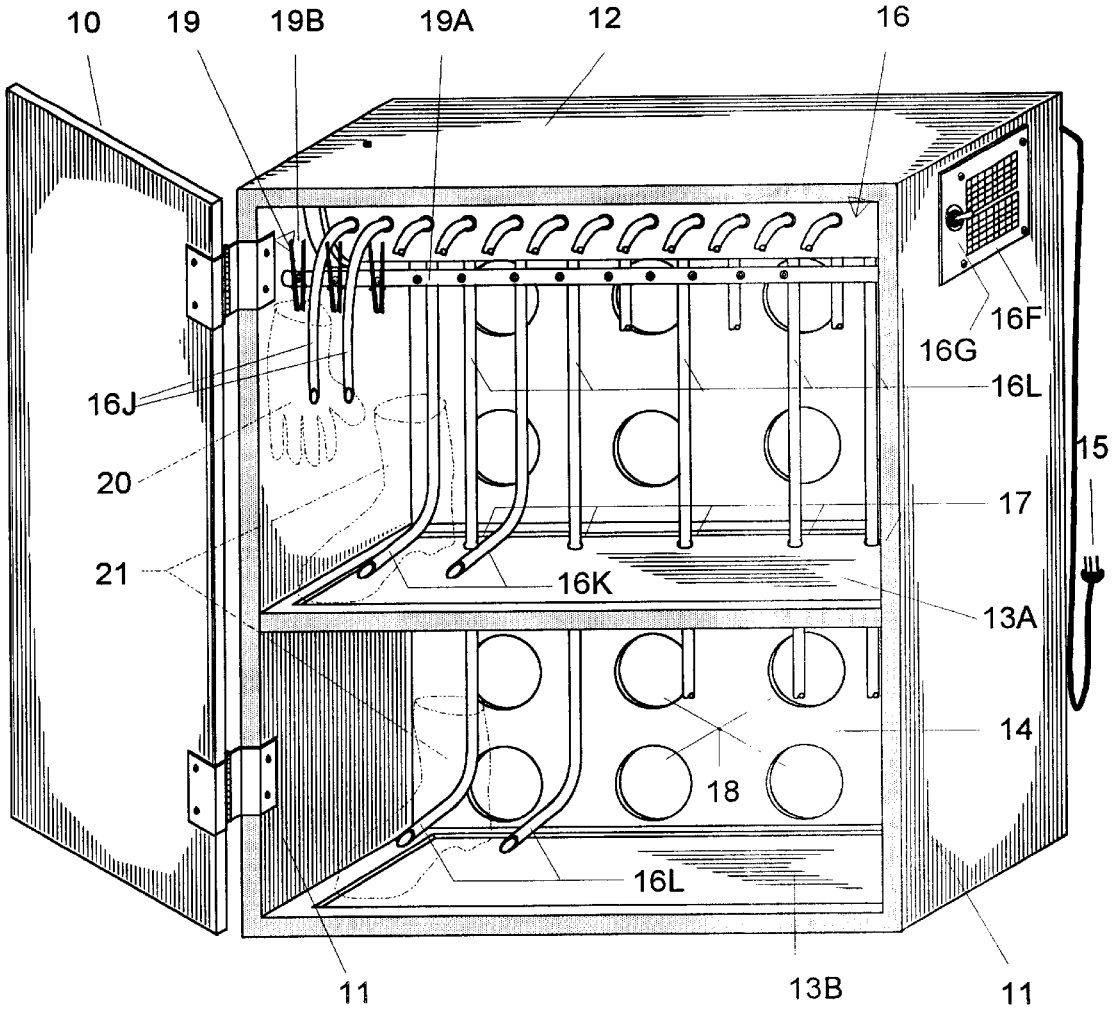
FIG. 1 is a perspective view of the present invention with the right door detail removed for clarity.

10 doors 11 sides
12 cabinet top 13A upper shelf
13B lower shelf 14 back
15 power cord 16 drying air distribution device
16A plenum 16B end cap
16C acoustic dampening washers 16D axial fan assembly
16E plenum mounting hardware 16F safety cover
16G control switch 16H conduit flow restrictors
16J glove conduits 16K upper shelf boot conduits
16L lower shelf boot conduits 16M axial fan power feed
17 boot conduit holes 18 rear exhaust holes
19 glove and mitten banger bar assembly 19A cross bar
19B glove and mitten clip 20 phantom glove (typical)
21 phantom boot (typical)

Figure 2:
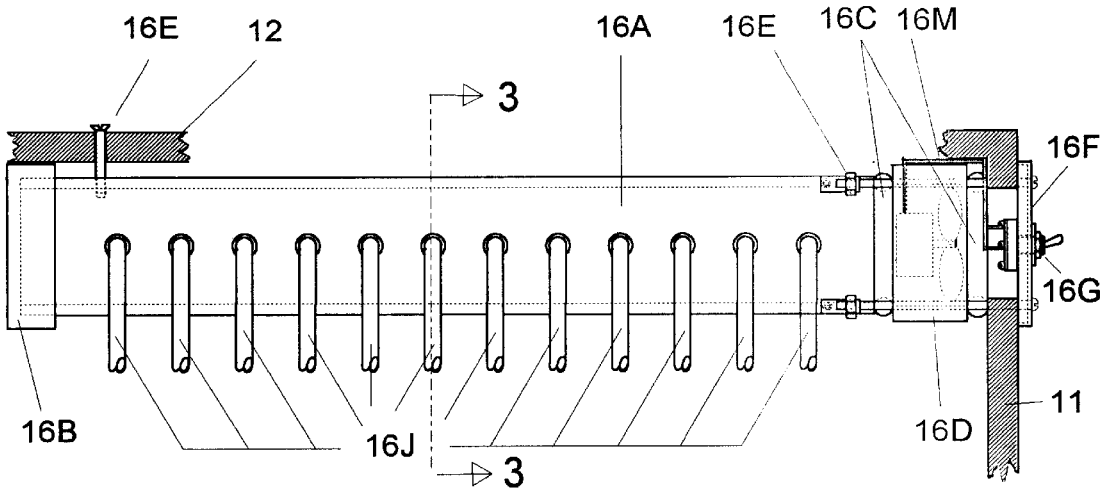
FIG. 2 is a front view of the drying air distribution device.
Figure 3:
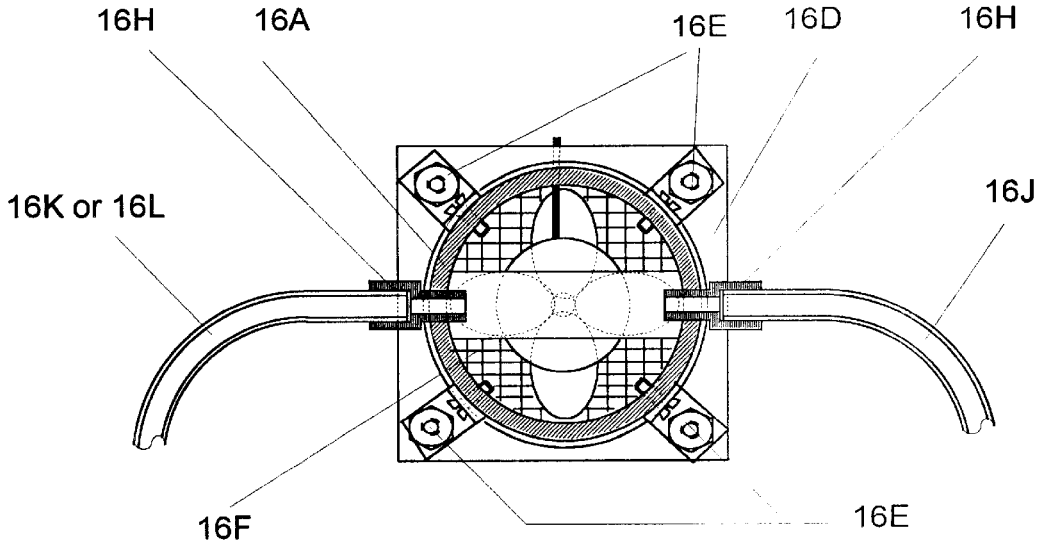
FIG. 3 is a larger scale cross sectional view of the drying air distribution device.

DETAILED DESCRIPTION OF THE PREFERRED EMBODIMENT—FIGS. 1 through 3

A typical working section of the foot and hand apparel dryer cabinet assembly is illustrated in FIG 1. Some repetitive details have been omitted for clarity of presentation and are specifically addressed below. The cabinet assembly has two sides 11, a cabinet top 12, an upper shelf 13A, a lower shelf 13B, a back 14, and two access doors 10. (The right door was intentionally omitted from FIG. 1 to improve clarity). A drying air distribution device 16 is installed horizontally across the underside of the cabinet top 12 and near the back 14. A glove and mitten hanger bar assembly 19 is similarly arranged horizontally in front of the drying air distribution device. The drying air distribution device and the cabinet can be constructed in a variety of sizes and configurations. FIG. 1 illustrates a cabinet sized to accommodate six pairs of shoes or boots and six pairs of gloves or mittens.

The space above the lower shelf is sized to accommodate three pairs of boots arranged with the heals near or against the back 14 as partially illustrated in phantom 21. Lower shelf boot conduits 16L (two of six illustrated) convey drying air from the drying air distribution device 16 to each boot location on the lower shelf.

The space above the upper shelf is sized to accommodate three additional pairs of boots, similarly arranged and supplied with drying air by upper shelf boot conduits 16K (two of six illustrated). Additionally, the upper shelf space accommodates six pairs of mittens or gloves suspended from the glove and mitten hanger bar assembly 19 as partially illustrated in phantom 20. Drying air is conveyed from the drying air distribution device 16 to each glove or mitten by glove conduits 16J (two of twelve illustrated).

All boot conduits are sized in length to reach the toe region of any boot placed on the shelf. Glove conduits are sized in length to reach the palm area of mittens or gloves. All boot and glove conduits are fabricated from flexible, non-abrasive tubing material and are terminated with an oblique angle to prevent flow blockage upon contact with the inside of an item of apparel.

The glove and mitten hanger bar assembly 19 features a cross bar 19A, which is horizontally disposed to span the distance between the cabinet sides, and glove and mitten clips 19B, which are attached to the cross bar 19A. Only three of twelve glove and mitten clips are illustrated to improve clarity.

The two cabinet shelves 13A and 13B may be fabricated either flat or with a central depression, similar to a serving tray, in order to retain melted snow or other liquids and prevent the liquids from damaging floors before they evaporate. The lower shelf boot conduits 16L must penetrate the upper shelf 13A through boot conduit holes 17. The boot conduit holes 17 are positioned between the boot storage locations on the upper shelf 13A and sufficiently away from the back 14 to allow easy insertion of the lower shelf boot conduits 16L into the boots or shoes on the lower shelf 13B. Rear exhaust holes 18 are provided in the cabinet back 14 to return moist air to the room as it exits the apparel being dried. The rear exhaust holes permit proper dryer operation with the cabinet doors 10 closed for aesthetics.

A typical drying air distribution device 16 is illustrated in front view in FIG. 2 and in cross section in FIG. 3. The drying air distribution device is comprised of a plenum 16A of hollow material with a round, square or other available cross section. The plenum 16A is illustrated as round polyvinylchloride pipe material in all the Figs. The plenum is closed at one end by an end cap 16B and the other end is aligned to the discharge of an equivalent diameter axial fan assembly 16D. Axial fans are typically used in computer cooling applications and operate with low noise and low power consumption. The axial fan assembly suction end is centered on an equivalent diameter hole in the cabinet side 11 through which the drying air is drawn. The axial fan assembly is acoustically isolated from both the cabinet side 11 and the plenum 16A by acoustic dampening washers 16C, which prevent fan noise from resonating within the cabinet A safety cover 16F is mounted on the cabinet side to cover the axial fan assembly intake. Plenum mounting hardware 16E is used to retain the plenum 16A, the axial fan assembly 16D, the acoustic dampening washers 16C and the safety cover 16F in place. A control switch 16G directs power to the axial fan assembly 16D via the axial fan power feed 16M. Standard 120 volt household power is provided through the power cord 15. Based upon manufacturing tradeoffs, the control switch may be located on the safety cover (as illustrated), on the plenum 16A or elsewhere on the cabinet side 11.

Conduit flow restrictors 16H provide the air passage transition from the plenum 16A to the various boot and glove conduits 16J, 16K, 16L. The conduit flow restrictors are retained in holes oriented horizontally along the front and rear of the plenum 16A. The glove conduits 16J attach to twelve conduit flow restrictors 16H exiting the front of the plenum 16A. The upper shelf boot conduits 16K and lower shelf boot conduits 16L attach alternately to twelve conduit flow restrictors 16H exiting the rear of the plenum 16A. Conduit flow restrictors 16H are sized to provide a restriction to the free flow of air and thereby cause approximately the same air flow rate through all conduits regardless of the conduit length or whether the conduit is inserted in an apparel item or unused. Accordingly, the conduit flow restrictors 16H preclude the need for any mechanical isolation of unused conduits.

Based upon the specific foot and hand apparel drying needs of a lodging unit, two or more working sections of the foot and hand apparel dryer cabinet assembly can be stacked vertically in a single enclosure to provide greater drying capacity; or the cabinet width can be increased to accommodate more apparel with a requisite increase in drying air distribution device capacity.

OPERATION—FIGS. 1 through 3

The simplicity of the manner of use of the subject invention is one of its main attributes. Damp or wet shoes or boots are placed heal first on either of the two shelves. While placing a shoe or boot on the upper shelf 13A or the lower shelf 13B, an upper shelf boot conduit 16K or a lower shelf boot conduit 16L, respectively, is inserted into the shoe or boot top such that the free end of the conduit feeds into the toe area of the shoe or boot. The final position of boots with conduits inserted are illustrated in phantom 21.

Damp or wet mittens or gloves are individually suspended from a glove and mitten clip 19B after a glove conduit 16J has been fed into the palm area.

Drying operation is initiated by energizing the axial fan assembly 16D with the control switch 16G. The fan draws ambient air into the plenum 16A. The twenty four conduit flow restrictors 16H cause the ambient air flow out of the plenum 16A to be relatively equally distributed among the twenty four attached boot or glove conduits. This assures adequate drying air flow to all apparel items and eliminates any operator requirement to close or block unused conduits. Moist air removed from apparel items is expelled out the rear exhaust holes 18. This feature allows the present invention to operate with the doors 10 closed and all unsightly apparel items out of sight The constant mixing of air streams within the cabinet also facilitates the drying of the outer surfaces of apparel placed therein.

The flow rate of the drying air in each conduit is predetermined to result in a comfortable dryness in each apparel item after overnight drying. Principle factors influencing the flow rate through individual conduits are the total number of conduits, the axial fan assembly diameter and flow rating, and the conduit flow restrictor size. The selection of a low noise axial fan and the sound deadening provided by the acoustic dampening washers 16C results in an operating noise level which is acceptable in an area used for sleeping, TV viewing or general conversation.

Since no heat source is used, continued operation for an extended period has no deleterious affect on dried apparel and presents no safety hazard. The cabinet provides perfect closed-door storage for dried apparel until the next use.

SUMMARY, RAMIFICATIONS AND SCOPE

Accordingly, the reader can see that the foot and hand apparel dryer cabinet assembly of this invention surpasses the prior art in providing safe, convenient, effective, economical and aesthetic overnight drying and storage of the damp boots, shoes, gloves, and mittens for an entire group of people. The ski lodging industry, as an example, might well conclude that the subject invention should be a standard furniture item in rental units. This would provide all the direct benefits to the skiers, as previously discussed; plus, it would reduce the wear and tear to carpets and walls caused by piles of wet and dirty boots.

Wide usage of this invention will result in significant energy conservation over the prior art in that no electrical heating is required and the installed fan consumes less than 25 watts of power. Moreover, this invention is safe from fire hazards, safe on apparel, safe to leave unattended, safe from contact with hot surfaces or moving parts and safe for children to operate.

This invention provides a closed storage location for all hand and foot apparel items. As closets contribute to the aesthetics of a lodging environment by providing out of sight storage for coats and hats, so to does the present invention improve aesthetics with its closed, quiet and carefree operation.

Although the description above contains many specificities, these should not be construed as limiting the scope of the invention but as merely providing illustrations of some of the presently preferred embodiments of this invention. For example, the cross section of the plenum could have other shapes such as a square, rectangle, hexagon, etc.; or the shelf width could accommodate a number of boots other than six; or the exhaust holes could be in a side of the cabinet instead of the back; or the ratio of total capacity of boots and shoes to total capacity of mittens and gloves could be changed from twelve-to-twelve to any other ratio. Also, conduit flow restrictors could incorporate an angled discharge from the plenum or be installed at a conduit location remote to the plenum.

Foot and hand apparel dryer cabinet assemblies can be stacked one over the other in the same enclosure with common or separate doors; or they can be incorporated into multi-use enclosures, such as an entertainment center above and the dryer assembly below.

Thus, the scope of the invention should be determined by the appended claims and their legal equivalents, rather than by the examples given.

What is claimed is:

1. A device for drying hand and foot apparel which comprises:

(a) an enclosed cabinet with internal means to support apparel for drying and means of ready access to the cabinet interior, (b) a drying air plenum within said cabinet, wherein a volume of ambient air is contained;

(c) a fan within said cabinet which supplies ambient air from outside the cabinet to said plenum;

(d) means for ambient air from outside said cabinet to be drawn into said fan through one or more holes in the cabinet;

(e) a plurality of conduits which convey fan driven ambient air from said plenum to the interior of hand and foot apparel;

(f) conduit flow restrictors within the drying air flow path of each said conduit which act to substantially equalize the air flow through all conduits; and (g) means for exhausting damp air from said cabinet, whereby air flow mixing within the cabinet causes drying of the external surfaces of apparel therein.

2. The device of claim 1, wherein said cabinet has shelves for boot and shoe storage and a glove and mitten hanger bar for storage of hand apparel.

3. The device of claim 2, wherein said shelves have a central depression, whereby liquid mud, melting snow or other boot-clinging liquids are retained until evaporated.

4. The device of claim 1, wherein said fan is a low noise, axial fan which is acoustically isolated from said cabinet, draws air through a safety cover, and operates from switched household electrical power.

5. The device of claim 1, wherein said cabinet has a furniture-finished exterior with doors which shield all drying apparel from view.

6. The device of claim 1, wherein the said plenum is polyvinylchloride pipe.

7. The device of claim 1, wherein said conduits are vinyl tubing.

8. The device of claim 1, wherein the discharge ends of said conduits terminate in an oblique angle.

9. The device of claim 1, wherein multiple devices are vertically stacked in a single enclosure.

* * * * *